US011557429B2

(12) United States Patent
Suzuki et al.

(10) Patent No.: US 11,557,429 B2
(45) Date of Patent: Jan. 17, 2023

(54) MULTILAYER COIL COMPONENT

(71) Applicant: Murata Manufacturing Co., Ltd., Kyoto-fu (JP)

(72) Inventors: Yuudai Suzuki, Nagaokakyo (JP); Kazuya Koizumi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 675 days.

(21) Appl. No.: 16/597,701

(22) Filed: Oct. 9, 2019

(65) Prior Publication Data

US 2020/0118737 A1 Apr. 16, 2020

(30) Foreign Application Priority Data

Oct. 12, 2018 (JP) ..... JP2018-193485

(51) Int. Cl.
*H01F 27/34* (2006.01)
*H01F 1/34* (2006.01)
(Continued)

(52) U.S. Cl.
CPC ..... *H01F 27/34* (2013.01); *H01F 1/344* (2013.01); *H01F 17/04* (2013.01); *H01F 27/24* (2013.01); *H01F 2027/2809* (2013.01)

(58) Field of Classification Search
None
See application file for complete search history.

(56) References Cited

U.S. PATENT DOCUMENTS 10,290,415 B2 * 5/2019 Koizumi ..... H01F 17/045
10,490,332 B2 * 11/2019 Kim ..... H01F 17/0033
(Continued)

FOREIGN PATENT DOCUMENTS

JP 2001-044039 A 2/2001
JP 2014-116396 A 6/2014
(Continued)

OTHER PUBLICATIONS

An Office Action; "Notice of Reasons for Refusal", mailed by the Japanese Patent Office dated Mar. 3, 2021, which corresponds to Japanese Patent Application No. 2018-193485 and is related to U.S. Appl. No. 16/597,701; with English language translation.
(Continued)

*Primary Examiner* — Kevin M Bernatz
(74) *Attorney, Agent, or Firm* — Studebaker & Brackett PC

(57) ABSTRACT

A multilayer coil component includes an inner conductor, a component element assembly including the inner conductor, and outer conductors disposed at respective end portions of the component element assembly. The component element assembly has a first region in which the primary component is composed of a magnetic material and which may contain a nonmagnetic material and second regions which are disposed at respective end portions of the first region and which contain at least a nonmagnetic material. Each second region is disposed having a greater volume content of the nonmagnetic material than the first region such that, for example, the difference in the volume content results about 25% by volume or more. The coil portion of the inner conductor is embedded in the first region, and the length of the second region is greater than or equal to the length of the side-surface folded portion of the outer conductor.

20 Claims, 7 Drawing Sheets

(51) Int. Cl.

| | |
|---|---|
| ***H01F 27/24*** | (2006.01) |
| ***H01F 17/04*** | (2006.01) |
| ***H01F 27/28*** | (2006.01) |

(56) References Cited

U.S. PATENT DOCUMENTS

2009/0068445 A1* 3/2009 Nishizawa ..... H01F 17/04 428/428
2010/0283447 A1* 11/2010 Tachibana ..... H01F 1/344 336/200
2013/0033347 A1* 2/2013 Matsuura ..... H01F 17/0013 336/83
2014/0145816 A1* 5/2014 Sato ..... H01F 17/0013 336/208
2014/0176286 A1* 6/2014 Okada ..... H01F 17/0013 336/200
2014/0191837 A1* 7/2014 Moon ..... H01F 17/0013 336/200
2014/0197917 A1* 7/2014 Naito ..... H01F 17/0013 336/200
2016/0260539 A1 9/2016 Koizumi
2017/0140868 A1* 5/2017 Kim ..... H01F 41/064
2017/0229223 A1* 8/2017 Okada ..... H01F 27/292
2017/0330673 A1* 11/2017 Sato ..... H01F 27/245
2017/0330675 A1* 11/2017 Sim ..... H01F 27/255
2017/0345552 A1* 11/2017 Nakano ..... H01F 27/292
2018/0057408 A1* 3/2018 Kakuda ..... H01F 41/0246
2018/0166198 A1* 6/2018 Kim ..... H01F 17/0033
2019/0131063 A1* 5/2019 Arai ..... H01F 27/2804
2020/0286665 A1* 9/2020 Hirukawa ..... B32B 18/00

FOREIGN PATENT DOCUMENTS

JP 2014116396 A * 6/2014
JP 2014-220469 A 11/2014
JP 2018-035027 A 3/2018
JP 2018-098489 A 6/2018
WO 2013-031842 A1 3/2013

OTHER PUBLICATIONS

An Office Action; "Notice of Reasons for Refusal," mailed by the Japanese Patent Office dated Jun. 24, 2021, which corresponds to Japanese Patent Application No. 2018-193485 and is related to U.S. Appl. No. 16/597,701 with English language translation.

* cited by examiner

Si

MULTILAYER COIL COMPONENT

CROSS-REFERENCE TO RELATED APPLICATION

This application claims benefit of priority to Japanese Patent Application No. 2018-193485, filed Oct. 12, 2018, the entire content of which is incorporated herein by reference.

BACKGROUND

Technical Field

The present disclosure relates to a multilayer coil component and, in particular, to a multilayer coil component, for example, a multilayer inductor, suitable for application to a high-frequency device in which a component element assembly contains a magnetic material and a nonmagnetic material.

Background Art

In recent years, increases in frequencies of frequency bands of various types of communication equipment, for example, cellular phones, have advanced, and multilayer coil components have been widely used as devices to remove noise signals in such high-frequency bands.

To obtain favorable frequency characteristics, it is important for this type of multilayer coil component to obtain a high impedance Z. However, the impedance Z in a high-frequency band is affected by stray capacitance between counter electrodes of an inner conductor constituting a coil. Therefore, to obtain a predetermined high impedance, it is necessary to reduce stray capacitance. Consequently, ferrite materials for the multilayer coil components for the purpose of reducing stray capacitance have been previously and intensively researched and developed.

For example, Japanese Unexamined Patent Application Publication No. 2014-220469 (Claim 1, paragraphs [0016] to [0021], and the like) proposes a composite ferrite composition containing a magnetic material and a nonmagnetic material, wherein the mixing ratio of the magnetic material to the nonmagnetic material is (20% by weight:80% by weight) to (80% by weight:20% by weight), the magnetic material is Ni—Cu—Zn-based ferrite, the nonmagnetic material contains oxides of at least Zn, Cu, and Si as primary components, and the nonmagnetic material contains borosilicate glass as a secondary component.

In Japanese Unexamined Patent Application Publication No. 2014-220469, the composite ferrite composition prepared so as to ensure a predetermined mixing ratio of the magnetic material composed of the Ni—Cu—Zn-based ferrite material to the nonmagnetic material denoted by a general formula $a(bZnO.cMgO.dCuO).SiO_2$ (where a=1.5 to 2.4, b=0.2 to 0.98, d=0.02 to 0.15, and b+c+d=1.00) is used, a ceramic layer is formed of the resulting composite ferrite composition, an inner conductor is embedded in the ceramic layer, and, as a result, a multilayer coil component (composite electronic component) is obtained.

In Japanese Unexamined Patent Application Publication No. 2014-220469, the ceramic layer is formed of the above-described composite ferrite composition so as to decrease the permittivity of the ceramic layer, to improve sinterability, and to reduce a stray capacitance that occurs between counter electrodes of the inner conductor.

However, in Japanese Unexamined Patent Application Publication No. 2014-220469, since the ceramic layer is formed of the composite material of the magnetic material and the nonmagnetic material, a decrease in permittivity is caused, the impedance Z is reduced, and there is a concern that favorable high-frequency characteristics including a predetermined high impedance cannot be ensured even though the stray capacitance can be reduced.

The above-described stray capacitance occurs not only between counter electrodes of the inner conductor but also between the inner conductor and the outer conductor. In this case, it is considered that the stray capacitance can be reduced by increasing the distance between the inner conductor and the outer conductor even when the component element assembly is formed of only the magnetic material. However, this is in contrast to the request for a size reduction of the multilayer coil component.

SUMMARY

The present disclosure was realized in consideration of such circumstances, and thus provides a multilayer coil component, suitable for application to a high-frequency device, that can reduce stray capacitance, that has favorable high-frequency characteristics, and that obtains high impedance.

The present inventors performed intensive research and, as a result, found that the occurrence of stray capacitance between an outer conductor and an inner conductor could be reduced by dividing a component element assembly into a first region in which the primary component was composed of a magnetic material and which might contain a nonmagnetic material and a second region which contained at least a nonmagnetic material, by forming a second region at each end of the first region, and by setting the content in terms of a volume ratio (hereafter referred to as "volume content") of the nonmagnetic material contained in the second region to be greater than the volume content in the first region, and the present inventors also found that a multilayer coil component in which stray capacitance could be reduced to a practically satisfiable level, in which a reduction in magnetic permeability could be suppressed so as to ensure large inductance, and which had favorable high-frequency characteristics including a high impedance Z could be obtained.

The present disclosure was realized based on the above-described findings. According to preferred embodiments of the present disclosure, a multilayer coil component includes an inner conductor, a component element assembly including the inner conductor, and outer conductors disposed at respective end portions of the component element assembly and electrically connected to the inner conductor, wherein the component element assembly has a first region in which the primary component is composed of a magnetic material and which may contain a nonmagnetic material and a second region which is disposed at each end portion of the first region and which contains at least a nonmagnetic material, and each of the second regions has a greater volume content of the nonmagnetic material than the first region.

In the case in which the first region contains a smaller volume content of the nonmagnetic material than the second region, direct current superposition characteristics can be improved without impairing the effects of preferred embodiments of the present disclosure.

According to preferred embodiments of the present disclosure, in the multilayer coil component, preferably, each of the outer conductors includes an end surface portion disposed on the end surface of the component element assembly and a side-surface folded portion disposed on the side surface of the component element assembly, and the second region is disposed from the end surface of the component element assembly to at least the edge of the side-surface folded portion. Consequently, since the second region is disposed at least in the region in contact with the outer conductor, the relative permittivity in the second region can be decreased, and stray capacitance that occurs between the outer conductor and the inner conductor can be reduced.

According to preferred embodiments of the present disclosure, in the multilayer coil component, preferably, the inner conductor includes a coil portion and an extended conductor portion, and the coil portion is embedded in the first region. In the case in which the coil portion is embedded in the first region containing the magnetic material as a primary component, as described above, a reduction in magnetic permeability can be suppressed so as to ensure large inductance, and favorable high-frequency characteristics including high impedance can be obtained.

According to preferred embodiments of the present disclosure, in the multilayer coil component, preferably, the inner conductor includes a coil portion and an extended conductor portion, and the inner conductor is disposed in the first region. In this case, not only the coil portion but also the extended conductor portion are disposed in the first region. Therefore, since the inner conductor is not present in the second region, substantially in the same manner as the above, a multilayer coil component in which a reduction in stray capacitance and large inductance can be ensured and which has favorable high-frequency characteristics including high impedance can be obtained.

In this case, preferably, one principal surface of the second region is disposed in contact with the outer conductor, and the other principal surface is in contact with the first region. Consequently, since the second region containing the nonmagnetic material is spread to the position in contact with the inner conductor, stray capacitance that occurs between the outer conductor and the inner conductor can be further reduced.

According to preferred embodiments of the present disclosure, in the multilayer coil component, preferably, the difference between the volume content of the nonmagnetic material in the second region and the volume content of the nonmagnetic material in the first region is about 25% by volume or more. Consequently, since the volume content of the nonmagnetic material in the second region is sufficiently greater than the volume content in the first region, stray capacitance in the second region can be effectively reduced while large inductance and high impedance are ensured in the first region.

According to preferred embodiments of the present disclosure, in the multilayer coil component, preferably, the volume content of the nonmagnetic material in the second region is about 25% by volume or more. Consequently, since the second region contains the nonmagnetic material sufficiently, the permittivity can be decreased in the second region, and stray capacitance that may occur between the outer conductor and the inner conductor can be reduced.

According to preferred embodiments of the present disclosure, in the multilayer coil component, preferably, the volume content of the nonmagnetic material in the first region is about 75% by volume or less. Consequently, since the first region contains the nonmagnetic material to the extent that does not affect the magnetic characteristics, a multilayer coil component in which a reduction in magnetic permeability can be suppressed so as to ensure large inductance and which has favorable high-frequency characteristics including high impedance can be obtained.

According to preferred embodiments of the present disclosure, in the multilayer coil component, preferably, the cross section of the component element assembly is assumed to be an observation region, the area ratio in the observation region of a constituent element that is not contained in the magnetic material and that is contained in only the nonmagnetic material is calculated, and the content of the nonmagnetic material in terms of a volume ratio is determined on the basis of the area ratio.

According to preferred embodiments of the present disclosure, in the multilayer coil component, preferably, the nonmagnetic material contains at least Si and Zn. Consequently, favorable sinterability in an air atmosphere can be ensured.

According to preferred embodiments of the present disclosure, in the multilayer coil component, preferably, the content of Zn relative to the content of Si is 1.8 to 2.2 in terms of a molar ratio.

According to preferred embodiments of the present disclosure, in the multilayer coil component, preferably, the primary component of the magnetic material is a ferrite material that contains at least Fe, Ni, Cu, and Zn. A multilayer coil component having favorable magnetic characteristics, for example, magnetic permeability, can be obtained by using such a magnetic material.

According to preferred embodiments of the present disclosure, in the multilayer coil component, preferably, the magnetic material contains 0.3 to 5 parts by weight of Co in terms of $Co_3O_4$ relative to 100 parts by weight of the primary component. Consequently, further favorable high-frequency characteristics can be obtained.

According to preferred embodiments of the present disclosure, in the multilayer coil component, preferably, the magnetic material contains 0.024 to 0.23 parts by weight of Bi in terms of $Bi_2O_3$ relative to 100 parts by weight of the primary component. Consequently, sinterability can be further improved.

According to preferred embodiments of the present disclosure, in the multilayer coil component, preferably, the inner conductor contains Ag as a primary component.

Other features, elements, characteristics and advantages of the present disclosure will become more apparent from the following detailed description of preferred embodiments of the present disclosure with reference to the attached drawings.

DETAILED DESCRIPTION

Next, the embodiments according to the present disclosure will be described in detail.

Figure 1:
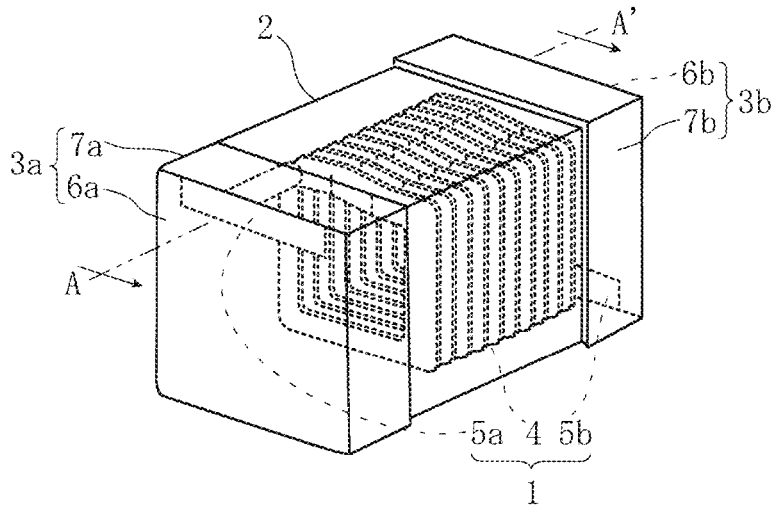
FIG. 1 is a schematic perspective view of a multilayer coil component according to an embodiment (first embodiment) of the present disclosure.
Figure 2:
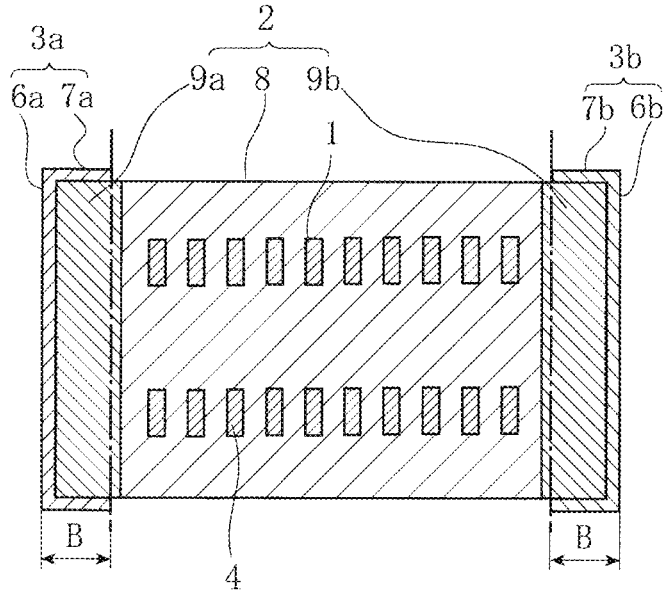
FIG. 2 is a sectional view of A-A' in the direction of the arrows in FIG. 1.

FIG. 1 is a schematic perspective view of a multilayer coil component according to an embodiment (first embodiment) of the present disclosure, and FIG. 2 is a sectional view of A-A' in the direction of the arrows in FIG. 1.

The multilayer coil component is composed of an inner conductor 1, a component element assembly 2 including the inner conductor 1, and outer conductors 3*a* and 3*b* disposed at respective end portions of the component element assembly 2, and the inner conductor 1 is set to have a horizontal winding structure.

The inner conductor 1 has a coil portion 4 that is wound spirally and extended conductor portions 5*a* and 5*b* disposed at respective ends of the coil portion 4. The outer conductors 3*a* and 3*b* have end surface portions 6*a* and 6*b*, respectively, disposed on the end surfaces of the component element assembly 2 and side-surface folded portions 7*a* and 7*b*, respectively, disposed on the side surfaces of the component element assembly 2. One end surface portion 6*a* is electrically connected to one extended conductor portion 5*a*, and the other end surface portion 6*b* is electrically connected to the other extended conductor portion 5*b*.

The component element assembly 2 has a first region 8 in which the primary component is composed of a magnetic material and second regions 9*a* and 9*b* which are disposed at respective end portions of the first region 8 and which contain at least a nonmagnetic material.

The coil portion 4 is embedded in the first region 8. Consequently, since the primary component of the first region 8 is composed of a magnetic material, a reduction in magnetic permeability can be suppressed, and compared with the related art, such as Japanese Unexamined Patent Application Publication No. 2014-220469, a large inductance can be ensured and favorable high-frequency characteristics and a high impedance Z can be obtained.

The second regions 9*a* and 9*b* are disposed from the end surfaces of the component element assembly 2 to at least the edges of the side-surface folded portions 7*a* and 7*b*, respectively. That is, the second regions 9*a* and 9*b* are disposed so as to have at least the length B of each of the side-surface folded portions 7*a* and 7*b* or may be disposed so as to be longer than the length B of each of the side-surface folded portions 7*a* and 7*b* provided that the second regions 9*a* and 9*b* do not enter the coil portion 4.

Since the second regions 9*a* and 9*b* containing the nonmagnetic material, as described above, are disposed at least in contact with the outer conductors 3*a* and 3*b*, respectively, the relative permittivity of the second regions 9*a* and 9*b* can be decreased, and stray capacitance that occurs between the outer conductor and the inner conductor can be effectively reduced.

The first region 8 may contain a nonmagnetic material provided that the primary component is composed of the magnetic material. The second regions 9*a* and 9*b* have to contain at least a nonmagnetic material and may contain a magnetic material. In particular, an appropriate amount of nonmagnetic material being contained in the first region 8 can contribute to an improvement in direct current superposition characteristics. However, even in this case, the volume contents of the magnetic material and the nonmagnetic material in each of the first region 8 and the second regions 9*a* and 9*b* are adjusted such that the volume content of the nonmagnetic material in the second regions 9*a* and 9*b* is greater than the volume content of the nonmagnetic material in the first region 8.

There is no particular limitation regarding the volume contents of the magnetic material and the nonmagnetic material in each of the first region 8 and the second regions 9*a* and 9*b* provided that the volume content of the nonmagnetic material in each of the second regions 9*a* and 9*b* is greater than the volume content of the nonmagnetic material in the first region 8. However, it is preferable that the difference between the volume content of the nonmagnetic material in each of the second regions 9*a* and 9*b* and the volume content of the nonmagnetic material in the first region 8 be about 25% by volume or more. Consequently, since the volume content of the nonmagnetic material in the second regions 9*a* and 9*b* is sufficiently greater than the volume content in the first region 8, stray capacitance in the second regions 9*a* and 9*b* can be effectively reduced while ensuring large inductance and high impedance in the first region 8.

The volume content of the nonmagnetic material in each of the second regions 9*a* and 9*b* is about 25% by volume or more, preferably about 50% by volume or more, and more preferably about 70% by volume or more. Consequently, since the second regions 9*a* and 9*b* contain the nonmagnetic material sufficiently, the permittivity can be decreased in the second regions 9*a* and 9*b*, and stray capacitance that may occur between the outer conductor and the inner conductor can be reduced.

As described above, the first region 8 may contain the nonmagnetic material. However, even in such a case, the volume content of the nonmagnetic material is preferably about 75% by volume or less. That is, favorable direct current superposition characteristics can be obtained by the first region 8 containing the nonmagnetic material, as described above. However, excessively containing the nonmagnetic material may reduce the magnetic permeability.

Therefore, even in the case in which the nonmagnetic material is contained in the first region 8, to avoid magnetic characteristics from being affected, the volume content of the nonmagnetic material is set to be preferably about 75% by volume or less. Consequently, a reduction in the magnetic permeability can be suppressed while ensuring favorable direct current superposition characteristics, and a multilayer coil component having favorable high-frequency characteristics including high impedance can be obtained.

There is no particular limitation regarding the nonmagnetic material. From the viewpoint of obtaining favorable sinterability, it is preferable that an oxide containing at least Si and Zn be used, and a zinc-silicate-based compound denoted by general formula (A) be used.

$$aZnO.SiO_2 \quad (A)$$

Here, constant a is stoichiometrically "2", but may be appropriately set to be within the range of about 1.8 to 2.2. In this regard, some Zn atoms in general formula (A) may be substituted with Mg, Cu, or the like, as the situation demands.

There is no particular limitation regarding the magnetic material, and a ferrite material of, for example, a Ni base, a Ni—Cu base, a Ni—Cu—Zn base, or the like may be used. Preferably, a Ni—Cu—Zn-based ferrite material capable of realizing favorable magnetic characteristics is used.

In the case in which the Ni—Cu—Zn-based ferrite material is used, there is no particular limitation regarding the compounding ratio of each constituent element. However, from the viewpoint of ensuring favorable magnetic characteristics, it is preferable that about 40% to 49.5% by mole of Fe in terms of $Fe_2O_3$, about 5% to 35% by mole of Zn in terms of ZnO, about 6% to 13% by mole of Cu in terms of CuO, and the remainder of Ni be combined and used.

It is also preferable that appropriate amounts of Co, Bi, Sn, Mn, and the like be contained in the magnetic material. In particular, in the case in which the Ni—Cu—Zn-based ferrite material is used, when about 0.3 to 5 parts by weight of Co in terms of $Co_3O_4$ is contained relative to 100 parts by weight of the primary component, high-frequency characteristics can be further improved. When about 0.024 to 0.23 parts by weight of Bi in terms of $Bi_2O_3$ is contained relative to 100 parts by weight of the primary component, the sinterability can be further improved. Here, the primary component refers to the total of oxides of Fe, Zn, Cu, and Ni constituting the Ni—Cu—Zn-based ferrite material.

As shown in the example described below, a cross section of the component element assembly 2 is observed by scanning transmission electron microscope (hereafter referred to as "STEM") or the like, constituent elements contained in only the magnetic material or the nonmagnetic material are subjected to mapping analysis, and the volume contents of the nonmagnetic material contained in the first region 8 and the second regions 9*a* and 9*b* may be calculated on the basis of the area ratio of the nonmagnetic material that is obtained by mapping analysis in the observation region. For example, in the case in which the magnetic material is composed of the Ni—Cu—Zn-based ferrite material and the nonmagnetic material is composed of the zinc-silicate-based compound containing at least Zn and Si, Fe is an element that is contained in the magnetic material only and not in the nonmagnetic material, and Si is an element that is contained in the nonmagnetic material only and not in the magnetic material. Therefore, when the mapping analysis is performed while elemental Fe and elemental Si are observed by STEM or the like, the region related to the elemental Fe and the region related to the elemental Si do not overlap each other and are present as isolated regions. Consequently, the elemental Si area ratio in the observation region of each of the first region 8 and the second regions 9*a* and 9*b* corresponds to the area ratio of the nonmagnetic material. The present inventors ascertained that the thus calculated elemental Si area ratio is substantially in accord with the volume content of the nonmagnetic material weighed during production of the component element assembly 2. Therefore, the area ratio obtained by the mapping analysis may be assumed to be the volume content of the nonmagnetic material. That is, the volume content of the nonmagnetic material may be determined on the basis of the area ratio.

The observation region of the component element assembly cross section may be set to be about 20 to 100 μm long and about 20 to 100 μm wide. Three observation regions may be observed, the area ratio of each observation region may be calculated, and the average value thereof may be assumed to be the area ratio.

There is no particular limitation regarding the material for forming the inner conductor 1, and Ag, Ag—Pd, Cu, Ni, and the like, which have good electrical conductivity, may be used. Usually, it is preferable that Ag be used because firing treatment can be performed stably in an air atmosphere.

There is no particular limitation regarding the outer conductors 3*a* and 3*b*. Usually, Ag, for example, Ag containing a glass component, is used as an underlying conductor, and a coating of Ni, Sn, or the like is formed on the underlying conductor in consideration of heat resistance, solderability, and the like.

As described above, the present multilayer coil component includes the inner conductor 1, the component element assembly 2 including the inner conductor 1, and the outer conductors disposed at respective end portions of the component element assembly 2 and electrically connected to the inner conductor 1. The component element assembly 2 has the first region 8 in which the primary component is composed of the magnetic material and which may contain the nonmagnetic material and the second regions 9*a* and 9*b* which are disposed at respective end portions of the first region 8 and which contain at least the nonmagnetic material. Since each of the second regions 9*a* and 9*b* has a greater volume content of the nonmagnetic material than the first region 8, stray capacitance that occurs between the outer conductors 3*a* and 3*b* and the inner conductor 1 can be reduced, and stray capacitance can be reduced to a practically satisfiable level. In the first region 8 containing the magnetic material as a primary component, a reduction in magnetic permeability is suppressed so as to ensure large inductance, and favorable high-frequency characteristics and high impedance can be obtained.

Next, a method for manufacturing the above-described multilayer coil component will be described in detail.

Magnetic raw materials, for example, $Fe_2O_3$, ZnO, CuO, NiO, and, as the situation demands, $Bi_2O_3$ and $Co_3O_4$, and nonmagnetic raw materials, for example, ZnO and $SiO_2$, are prepared as starting materials. Predetermined amounts of the above-described magnetic raw materials are weighed. The weighed materials are placed into a pot mill with pulverization media, for example, partially stabilized zirconia (PSZ) balls, wet-mixed sufficiently, pulverized, dried, and calcined at a temperature of about 700° C. for about 2 hours. In this manner, a magnetic material is produced.

Predetermined amounts of the above-described nonmagnetic raw materials are weighed. The weighed materials are wet-mixed sufficiently, pulverized, dried, and calcined at a temperature of about 1,100° C. for about 2 hours in the same method and procedure as above. In this manner, a nonmagnetic material is produced.

A conductive paste containing Ag or the like as a primary component is prepared.

Subsequently, the component element assembly 2 is produced by using the magnetic powder, the nonmagnetic powder, and the conductive paste.

Figure 3:
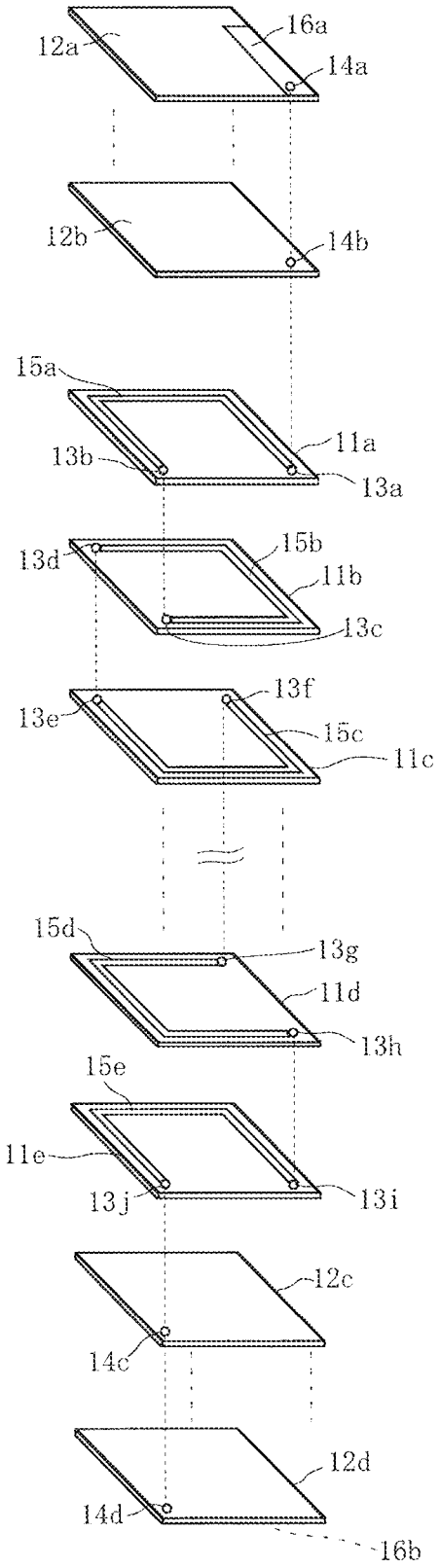
FIG. 3 is an exploded perspective view of a component element assembly according to the first embodiment.

FIG. 3 is an exploded perspective view of a green multilayer body that serves as the component element assembly 2. In FIG. 3, only one multilayer body is shown for the sake of facilitating explanation. However, usually, a multilayer body block is formed on a base film of polyethylene terephthalate (PET) or the like, and the multilayer block is cut lengthways and widthways by using a cutting tool, for example, a dicer, so as to separate individual pieces from each other. In this manner, a plurality of multilayer bodies are obtained from one multilayer body block.

Initially, a plurality of first sheets 11 serving as the first region 8 after firing and a plurality of second sheets 12 serving as the second regions 9*a* and 9*b* after firing are produced. In FIG. 3, five first sheets 11*a* to 11*e* are shown as the first sheets 11, and four second sheets 12*a* to 12*d* are shown as the second sheets 12.

Specifically, the first sheets 11 may be formed by the following method.

Each of the magnetic powder and the nonmagnetic powder is weighed such that the volume content of the nonmagnetic material after firing becomes less than the volume content in the second sheets 12, for example, such that the difference in the volume content of the nonmagnetic material after firing relative to the second sheets 12 becomes about 25% by volume or more.

Subsequently, the weighed materials are mixed with predetermined amounts of aqueous acrylic binder and dispersing agent, placed into a pot mill with pulverization media, and wet-mixed and pulverized sufficiently so as to obtain a first slurry. Thereafter, the first slurry is formed into the shape of a sheet by using a forming method, for example, a doctor blade method, and stamped into substantially a rectangle so as to produce the first sheets 11 (11*a* to 11*e*) having a thickness of about 10 to 25 μm.

The second sheets 12 may be produced by the following method.

Each of the magnetic powder and the nonmagnetic powder is weighed such that the volume content of the nonmagnetic material after firing becomes greater than the volume content in the first sheets 11, for example, such that the difference in the volume content of the nonmagnetic material after firing relative to the first sheets 11 becomes about 25% by volume or more.

Subsequently, in the same production procedure as for the first sheets 11, the weighed materials are mixed with predetermined amounts of aqueous acrylic binder and dispersing agent, placed into a pot mill with pulverization media, for example, PSZ balls, and wet-mixed and pulverized sufficiently so as to obtain a second slurry. Thereafter, the second slurry is formed into the shape of a sheet by using a forming method, for example, a doctor blade method, and stamped into substantially a rectangle so as to produce a plurality of second sheets 12 (12*a* to 12*d*) having a thickness of about 10 to 25 μm. In this regard, preferably, the number of the second sheets 12 produced is determined such that the thickness of each of the second regions 9*a* and 9*b* after firing corresponds to at least the length of each of the side-surface folded portions 7*a* and 7*b* of the outer conductors 3*a* and 3*b*, respectively.

Thereafter, each of the first sheets 11 (11*a* to 11*e*) and the second sheets 12 (12*a* to 12*d*) is subjected to laser irradiation or the like so as to form via holes at predetermined locations.

The surfaces of the first sheets 11*a* to 11*d* and the second sheets 12*a* and 12*d* are coated with a conductive paste by a screen printing method or the like, and drying is performed so as to form conductive layers 15*a* to 15*e*, 16*a*, and 16*b* with predetermined patterns. The via holes are filled with the conductive paste so as to form via conductors 13*a* to 13*j* and 14*a* to 14*d*.

The first sheets 11*a* to 11*e* are stacked such that the conductive layers 15*a* to 15*e* constitute a spiral through the via conductors 13*a* to 13*j*, and second sheets 12*a* to 12*d* are stacked on both ends. Pressure bonding is performed by pressurization under heating. In this manner, a multilayer body is produced.

The resulting multilayer body is placed into a sagger, and debinding treatment is performed in an air atmosphere at a temperature of about 300° C. to 500° C. Thereafter, firing treatment is performed at a temperature of about 900° C. to 920° C. for about 2 to 15 hours, the sintered body surface is subjected to barrel polishing, and the corner portions are made into an R-shape. In this manner, the component element assembly 2 is produced.

Both end portions of the resulting component element assembly 2 are coated with the conductive paste, and baking treatment is performed so as to form underlying conductors composed of Ag or the like. The resulting underlying conductors are subjected to electroplating or the like so as to form a Ni coating and a Sn coating sequentially. In this manner, the outer conductors 3*a* and 3*b* are formed, and the multilayer coil component in which the inner conductor 1 has a horizontal winding structure is obtained.

As described above, the present multilayer coil component can readily be obtained by applying a sheet method.

Figure 4:
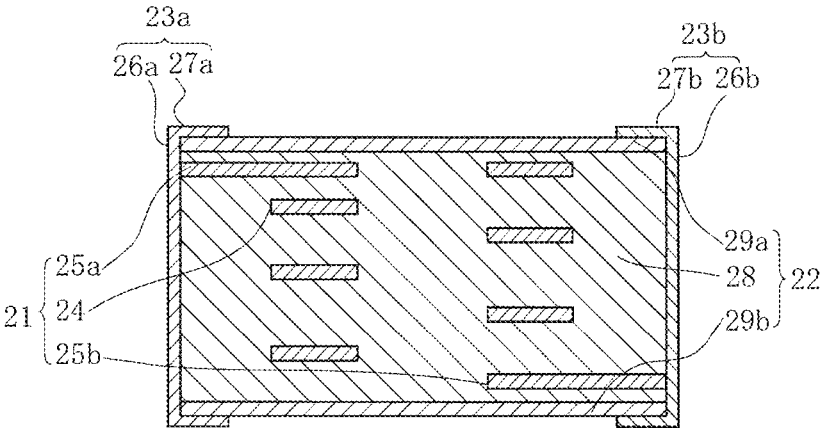
FIG. 4 is a schematic sectional view of a multilayer coil component according to a second embodiment of the present disclosure.

FIG. 4 is a schematic sectional view of a multilayer coil component according to a second embodiment of the present disclosure. In the above-described first embodiment, the inner conductor 1 has a horizontal winding structure. However, in the present second embodiment, an inner conductor 21 has a vertical winding structure.

That is, in the same manner as in the first embodiment, the present multilayer coil component includes an inner conductor 21, a component element assembly 22 including the inner conductor 21, and outer conductors 23*a* and 23*b* disposed at respective end portions of the component element assembly 22. The inner conductor 21 has a spirally wound coil portion 24 and extended conductor portions 25*a* and 25*b* disposed at respective ends of the coil portion 24. The outer conductors 23*a* and 23*b* have end surface portions 26*a* and 26*b* disposed on the end surfaces of the component element assembly 22 and side-surface folded portions 27*a* and 27*b* disposed on the side surfaces of the component element assembly 22. One end surface portion 26*a* is electrically connected to one extended conductor portion 25*a*, and the other end surface portion 26*b* is electrically connected to the other extended conductor portion 25*b*.

The component element assembly 22 has a first region 28 in which the primary component is composed of a magnetic material and second regions 29*a* and 29*b* which are disposed at respective top and bottom portions of the first region 28 and which contain at least a nonmagnetic material.

In the present second embodiment, each of the coil portion 24 and the extended conductor portions 25*a* and 25*b* that constitute the inner conductor 21 is disposed so as to be embedded in the first region 28. That is, in the present second embodiment, not only the coil portion 24 but also the extended conductor portions 25*a* and 25*b* are embedded in the first region 28, and no inner conductor is present in the second regions 29*a* and 29*b*. Consequently, stray capacitance that occurs between the outer conductors 23*a* and 23*b* and the inner conductor 21 can be sufficiently reduced. Since a reduction in magnetic permeability in the first region 28 containing the magnetic material as a primary component is suppressed, large inductance can be ensured, and favorable high-frequency characteristics and high impedance can be obtained.

In this regard, in the second embodiment, the inner conductor 21 is embedded in the first region 28. However, from the viewpoint of further effective reduction in stray capacitances in the second regions 29*a* and 29*b*, it is also preferable that the inner conductor 21 be not entirely embedded in the first region 28, and the other principal surfaces of the second regions 29*a* and 29*b* be disposed in contact with the inner conductor 21. In this case, since the second regions 29*a* and 29*b* containing the nonmagnetic material are spread to the position in contact with the inner conductor 21, stray capacitance that occurs between the outer conductors 23*a* and 23*b* and the inner conductor 21 can be further reduced.

The multilayer coil component according to the second embodiment can readily be produced by applying the sheet method, in the same manner as in the first embodiment.

That is, in the same method and procedure as in the first embodiment, the magnetic material and the nonmagnetic material are produced, and the conductive paste is prepared.

Subsequently, the component element assembly 22 is produced by using the magnetic powder, the nonmagnetic powder, and the conductive paste.

Figure 5:
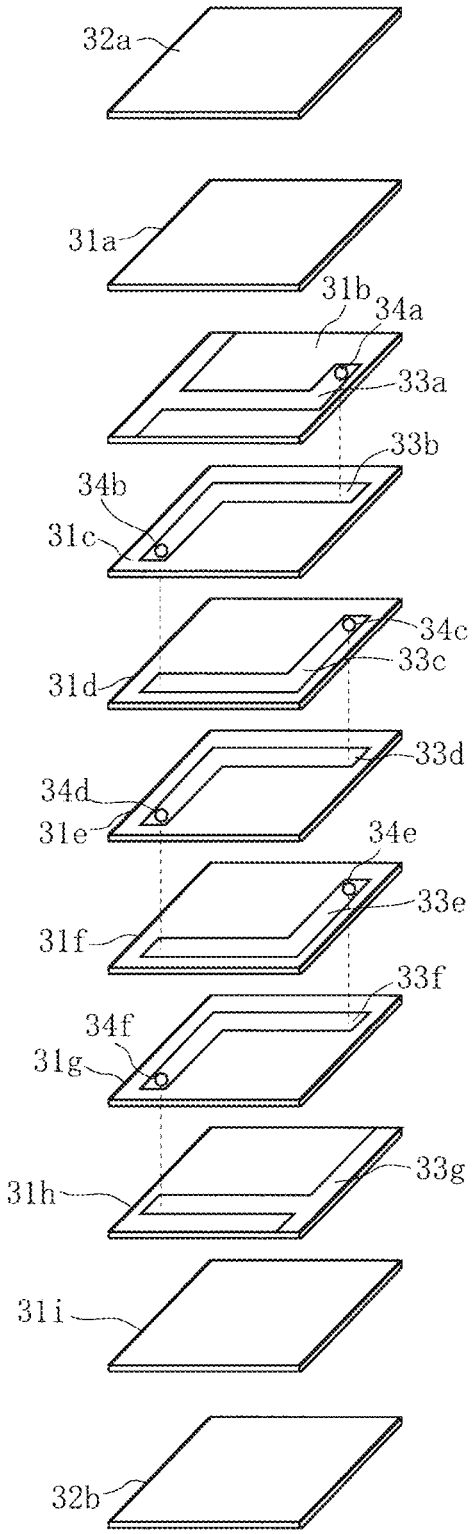
FIG. 5 is an exploded perspective view of a component element assembly according to the second embodiment.

FIG. 5 is an exploded perspective view of a green multilayer body that serves as the component element assembly 22.

Initially, first sheets 31*a* to 31*i* serving as the first region 28 after firing and second sheets 32*a* and 32*b* serving as the second regions 29*a* and 29*b* after firing are produced in the same method and procedure as in the first embodiment.

Thereafter, the first sheets 31*b* to 31*g* are subjected to laser irradiation or the like so as to form via holes at predetermined locations.

The surfaces of the first sheets 31*b* to 31*h* are coated with a conductive paste by a screen printing method or the like, and drying is performed so as to form conductive layers 33*a* to 33*g* with predetermined patterns. The via holes are filled with the conductive paste so as to form via conductors 34*a* to 34*f*.

The first sheets 31*a* to 31*i* are stacked such that the conductive layers 33*a* to 33*g* constitute a spiral through the via conductors 34*a* to 34*f*, and second sheets 32*a* and 32*b* are stacked on both ends. Pressure bonding is performed by pressurization under heating. In this manner, a multilayer body is produced.

In the same manner as in the first embodiment, the resulting multilayer body is placed into a sagger, and debinding treatment, firing treatment, and the like are performed sequentially so as to produce the component element assembly 22. Thereafter, outer conductors 23*a* and 23*b* are formed. In this manner, the multilayer coil component in which the inner conductor 21 has a vertical winding structure is obtained.

As described above, the present multilayer coil component can readily be obtained by using the sheet method, in the same manner as in the first embodiment.

In the second embodiment, the first sheets 31*a* and 31*i* are disposed on the upper surface of the first sheet 31*b* provided with the conductive layer 33*a* and the lower surface of the first sheet 31*h* provided with the conductive layer 33*g*, respectively. However, in the case in which the inner conductor 22 after firing is disposed in contact with the second regions 29*a* and 29*b*, a multilayer body may be formed by disposing a plurality of second sheets containing the nonmagnetic material instead of the first sheets 31*a*, 31*i*, and 31*h*.

In this regard, the present disclosure is not limited to the above-described embodiments and can be variously modified within the bounds of not departing from the gist. In the present disclosure, each of the second regions 9*a*, 9*b*, 29*a*, and 29*b* has to contain at least a nonmagnetic material and the volume content thereof has to be greater than the volume content of the nonmagnetic material that may be contained in the first region 28. The values of the above-described volume contents indicate preferable ranges and the volume contents are not limited to these values.

The magnetic materials and the nonmagnetic materials are exemplifications, and incidental impurities are allowed to be contained within the bounds of not affecting the characteristics.

Next, the examples according to the present disclosure will be specifically described.

EXAMPLES

Multilayer coil components, including an inner conductor, that had a first region composed of only the magnetic material and a second region, in which a mixing ratio of the nonmagnetic material and the magnetic material was different on a multilayer coil component basis, and that had a horizontal winding structure were produced, disc-like samples containing the same composition components as the second regions were produced, and characteristics were evaluated.

Production of Magnetic Material and Nonmagnetic Material

Regarding magnetic raw materials, $Fe_2O_3$, ZnO, CuO, and NiO that constituted primary components and $Bi_2O_3$ and $Co_3O_4$ that constituted secondary components were prepared. The primary component raw materials were weighed such that $Fe_2O_3$ was 48% by mole, ZnO was 20.0% by mole, CuO was 9.0% by mole, and NiO was 23.0% by mole. In addition, 0.15 parts by weight of $Bi_2O_3$ and 2.0 parts by weight of $Co_3O_4$ relative to 100 parts by weight of primary components were weighed. The weighed materials were placed into a pot mill with PSZ balls, wet-mixed sufficiently, pulverized, dried, and calcined at a temperature of 700° C. for 2 hours. In this manner, a magnetic material was produced.

Regarding nonmagnetic raw materials, ZnO and $SiO_2$ were prepared. Each of ZnO and $SiO_2$ was weighed such that $ZnO:SiO_2=2:1$ applied. The weighed materials were placed into a pot mill with PSZ balls, wet-mixed sufficiently, pulverized, dried, and calcined at a temperature of 1,100° C. for 2 hours. In this manner, a nonmagnetic material was produced.

Production of First and Second Sheets

The resulting magnetic materials were mixed with predetermined amounts of aqueous acrylic binder and dispersing agent, placed into a pot mill with PSZ balls, wet-mixed and pulverized sufficiently so as to obtain a first slurry. Thereafter, the first slurry was formed into the shape of a sheet by using a doctor blade method and stamped into substantially a rectangle so as to produce first sheets having a thickness of 25 μm.

Subsequently, the above-described nonmagnetic material and magnetic material were weighed such that the volume content of the nonmagnetic material was set to be 0% by volume, 25% by volume, 50% by volume, 75% by volume, or 100% by volume, the weighed materials were mixed with predetermined amounts of aqueous acrylic binder and dispersing agent, placed into a pot mill with PSZ balls, wet-mixed and pulverized sufficiently so as to obtain a second slurry. Thereafter, the second slurry was formed into the shape of a sheet by using a doctor blade method and stamped into a rectangle so as to produce second sheets having a thickness of 25 μm of sample Nos. 1 to 5.

Production of Sample

Production of Multilayer Coil Component

The first sheets and the second sheets were subjected to laser irradiation so as to form via holes at predetermined locations.

The surfaces of the first sheets were coated with a conductive paste by a screen printing method, and drying was performed so as to form conductive layers serving as the coil portion after firing. The via holes were filled with the conductive paste so as to form via conductors.

Of the second sheets, the surfaces of the second sheets at the end portions were coated with a conductive paste by a screen printing method, and drying was performed so as to form conductive layers serving as extended conductors after firing. The via holes were filled with the conductive paste so as to form via conductors.

The first sheets were stacked such that the conductive layers constitute a spiral through the via conductors. Second sheets were stacked such that the thickness corresponded to the length of the side-surface folded portion of the outer conductor and that the conductive layer was arranged as the end surface. The first sheets were held between two sets of the above-described stacked second sheets. Pressurization under heating was performed so as to produce a multilayer body. The resulting multilayer body was placed into a sagger and fired at a temperature of 920° C. for 5 hours. Thereafter, the sintered body surface was subjected to barrel polishing, and the corner portions were made into an R-shape. In this manner, the component element assembly was obtained.

The end surface portions of the resulting component element assembly were coated with the conductive paste, and baking treatment was performed at a temperature of 800° C. so as to form underlying conductors. The resulting underlying conductors were subjected to electroplating so as to form a Ni coating and a Sn coating sequentially and to form outer conductors. In this manner, the multilayer coil components (samples) having a horizontal winding structure of Sample Nos. 1 to 5 were obtained. Regarding the external dimensions of each multilayer coil component, the length L was 1.0 mm, the width W was 0.5 mm, and the thickness T was 0.5 mm. The number of turns of the coil was 30 turns.

Production of Disc-Like Sample

A plurality of second sheets of each of sample Nos. 1 to 5 were stacked, and pressurization under heating was performed so as to produce a multilayer body. The multilayer body was subjected to stamping, and firing at 920° C. for 5 hours was performed so as to produce a disc-like element assembly. Subsequently, both principal surfaces of the disc-like element assembly were coated with an In—Ga alloy so as to form electrodes. In this manner, the disc-like sample of each of sample Nos. 1 to 5 was produced. Regarding the external dimensions of the disc-like sample, the diameter was 10 mm and the thickness was 1 mm.

Evaluation of Characteristics

The multilayer coil component of each of sample Nos. 1 to 5 was used, and the area ratios of the elemental Fe and the elemental Si in the first region and the second region were determined.

Specifically, the area ratios of the elemental Fe and the elemental Si in the second region were determined by the following method.

The circumference of the sample was fixed by using a resin such that the LW surface demarcated by the length L and the width W was exposed at the surface. Polishing was performed up to a substantially central portion of the component by using a polishing machine.

Three observation regions of 50 μm long and 50 μm wide were selected from a region being a substantially central portion between the end surface of the component element assembly and the coil portion opposing the end surface, the region being also a substantially central portion in the W-direction, and mapping analysis of the elemental Fe and the elemental Si was performed by using STEM (HD-2300A produced by Hitachi High-Technologies Corporation). As a result, it was ascertained that the place relative to the elemental Fe and the place relative to the elemental Si did not overlap each other and were present as isolated places. Regarding each of the three observation regions, the area relative to the elemental Si was determined, and the average value was used for the area ratio.

As a result, the area ratio of the elemental Si was substantially in accord with the volume content of the nonmagnetic material weighed when the sample was formed. Therefore, the area ratio of the elemental Si was assumed to be the volume content of the nonmagnetic material.

Figure 6:
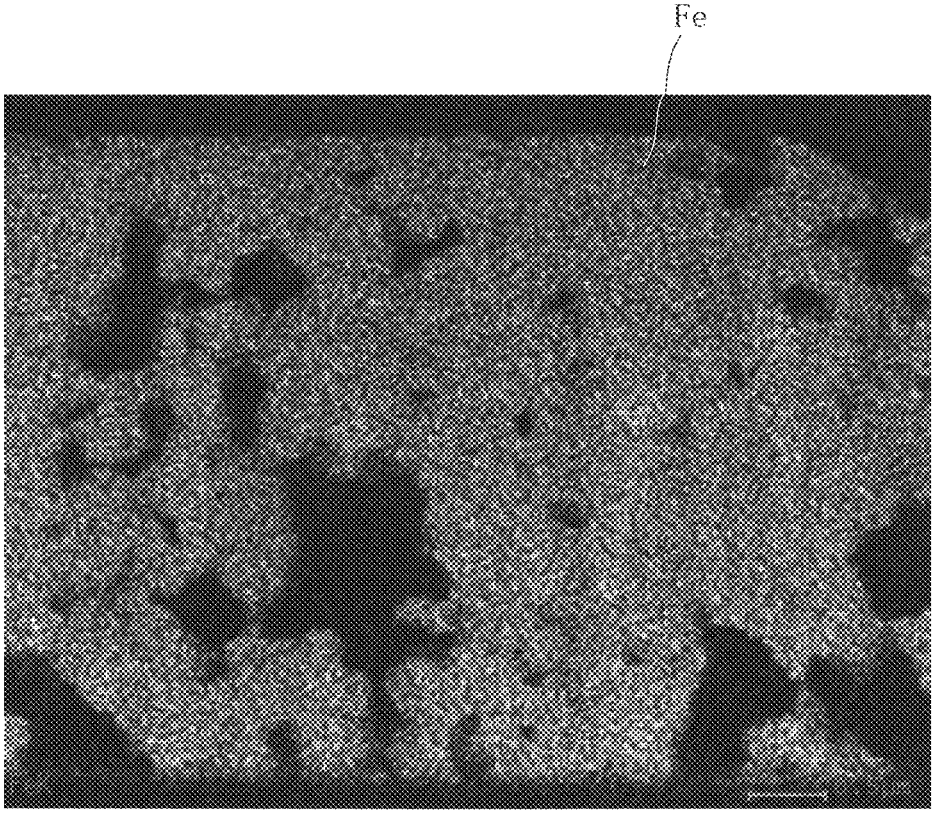
FIG. 6 is a diagram showing mapping analysis of elemental Fe contained in sample No. 2.
Figure 7:
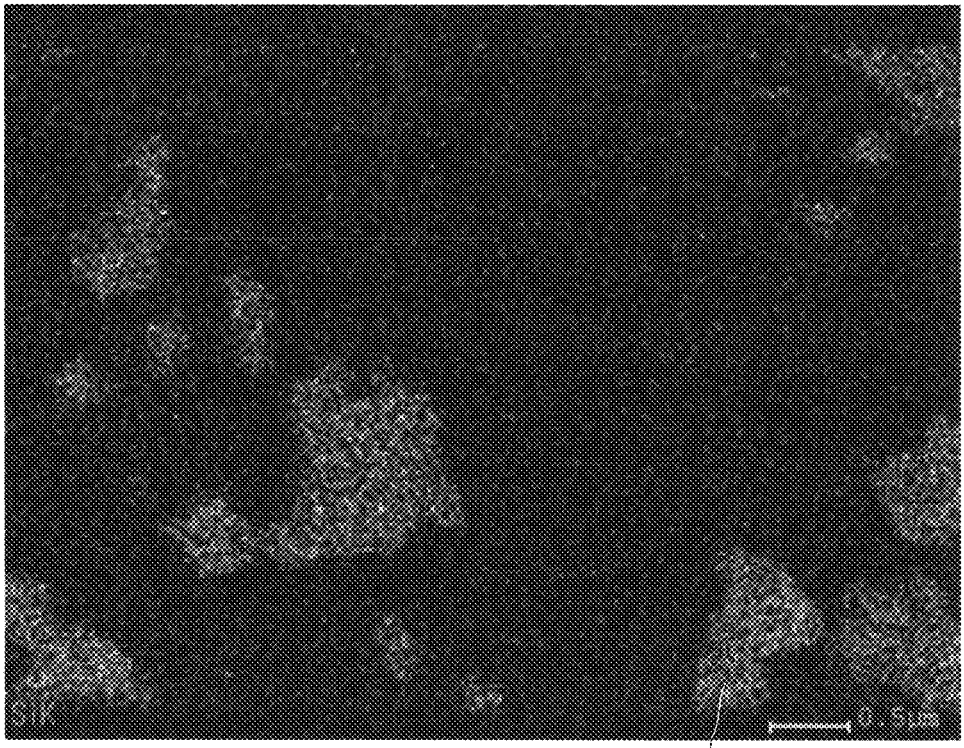
FIG. 7 is a diagram showing mapping analysis of elemental Si contained in sample No. 2.

Each of FIG. 6 and FIG. 7 is a diagram showing an example of the mapping analysis. FIG. 6 shows the mapping analysis of the elemental Fe in sample No. 2, and FIG. 7 shows the mapping analysis of the elemental Si in sample No. 2.

As is clear from FIG. 6 and FIG. 7, since the elemental Fe is contained in the magnetic material and the elemental Si is contained in the nonmagnetic material, even when the mapping analysis is performed, the place related to the elemental Fe and the place related to the elemental Si do not overlap each other and are present as isolated places, as described above. The result of determining the average value of the area ratios of the elemental Si in the three observation regions partly shown in FIG. 7 was about 25%. That is, it was found that since the area ratio of the elemental Si substantially corresponded to the volume content of the nonmagnetic material, the area ratio was assumed to be the volume content of the nonmagnetic material in the second region.

Meanwhile, regarding the first region, in the same method and procedure as in the above, the elemental Fe and the elemental Si in three observation regions at a substantially central portion in the L-direction and the W-direction of each sample were subjected to mapping analysis. Since no elemental Si is contained in the first region in the present example, presence of the elemental Si is not observed by mapping analysis and, therefore, it was ascertained that the magnetic material was substantially 100% by volume.

Next, regarding the multilayer coil component of each of sample Nos. 1 to 5, an impedance analyzer (4991A produced by Agilent Technologies Japan, Ltd.) was used, and an impedance Z was measured under the measurement conditions of a temperature of 20° C.±1° C., a measurement frequency of 1 MHz to 3 GHz, and a measurement voltage of 50 mV rms.

Meanwhile, regarding the disc-like sample of each of sample Nos. 1 to 5, an LCR meter (4284A produced by Agilent Technologies Japan, Ltd.) was used, an electrostatic capacity was measured at a measurement frequency of 1 MHz, and relative permittivity a was determined from the electrostatic capacity and the sample dimensions.

Table 1 shows the volume content of each of the nonmagnetic material and the magnetic material in the first region and the second region, the difference in the content of the nonmagnetic material between the first region and the second region, and the measurement results.

TABLE 1

| | Second region | | First region | | Difference in content of nonmagnetic material | Relative | |
|---|---|---|---|---|---|---|---|
| Sample No. | Nonmagnetic material (vol %) | Magnetic material (vol %) | Nonmagnetic material (vol %) | Magnetic material (vol %) | between second region and first region (vol %) | permittivity εr (—) | Impedance Z (Ω) |
| 1* | 0 | 100 | 0 | 100 | 0 | 15.0 | 1636 |
| 2 | 25 | 75 | 0 | 100 | 25 | 13.0 | 1646 |

TABLE 1-continued

| Sample No. | Second region Nonmagnetic material (vol %) | Second region Magnetic material (vol %) | First region Nonmagnetic material (vol %) | First region Magnetic material (vol %) | Difference in content of nonmagnetic material between second region and first region (vol %) | Relative permittivity εr (—) | Impedance Z (Ω) |
|---|---|---|---|---|---|---|---|
| 3 | 50 | 50 | 0 | 100 | 50 | 10.9 | 1656 |
| 4 | 75 | 25 | 0 | 100 | 75 | 8.6 | 1666 |
| 5 | 100 | 0 | 0 | 100 | 100 | 6.8 | 1674 |

asterisked sample is out of the scope of the present disclosure

In sample No. 1, neither the first region nor the second region contained nonmagnetic material, and the component element assembly was composed of only the magnetic material. Therefore, the relative permittivity εr was as large as 15.0 and the impedance Z was as low as 1,636Ω.

On the other hand, in each of sample Nos. 2 to 5, since the volume content of the nonmagnetic material in the second region was greater than that in the first region, the relative permittivity εr decreased to 13.0 or less. Since the relative permittivity εr decreased as described above, it was conjectured that stray capacitance which occurred between the outer conductor and the inner conductor could be reduced. The impedance Z was 1,646Ω or more and, therefore, it was found that a high impedance could be obtained compared with sample No. 1.

In addition, as is clear from sample Nos. 2 to 5, the relative permittivity εr decreased as the volume content of the nonmagnetic material in the second region increased and as the difference in the volume content of the nonmagnetic material between the second region and the first region increased. Since the relative permittivity decreased as described above, it was conjectured that stray capacitance could be more effectively reduced, and it was found that the impedance increased.

As is clear from the results of the present example, the volume content of the nonmagnetic material in the second region and the difference in the volume content of the nonmagnetic material between the second region and the first region were 25% by volume or more, the volume content of the magnetic material in the first region was 100% by volume, and favorable results were obtained in these ranges.

Figure 8:
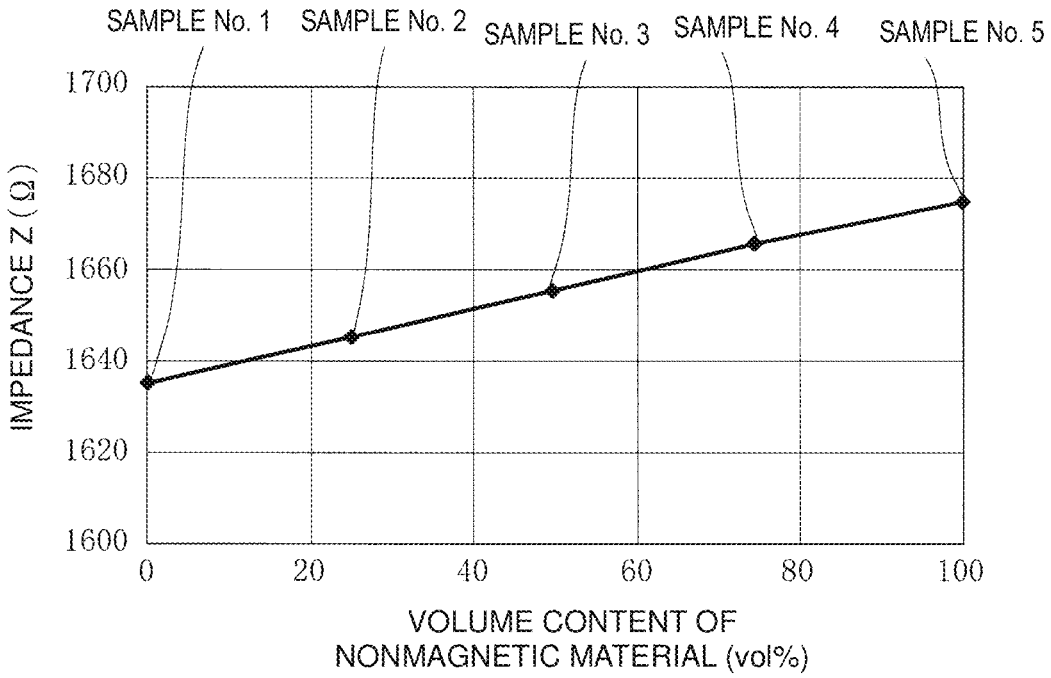
FIG. 8 is a diagram showing impedances of sample Nos. 1 to 5.

FIG. 8 is a diagram showing impedance characteristics in the present example. The horizontal axis indicates the volume content (% by volume) of the nonmagnetic material and the vertical axis indicates the impedance Z (Ω).

As clearly shown in FIG. 8, a higher impedance was obtained as the volume content of the nonmagnetic material in the second region increased.

A multilayer coil component suitable for application to a high-frequency device that can reduce stray capacitance, that has favorable high-frequency characteristics, and that obtains high impedance can be obtained.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

an inner conductor;

a component element assembly including the inner conductor, the component element assembly having a first region in which the primary component is composed of a magnetic material and which may contain a nonmagnetic material, and second regions which are disposed at respective end portions of the first region and which contain the nonmagnetic material, and each of the second regions has a content of the nonmagnetic material greater in terms of a volume ratio than a content of the nonmagnetic material of the first region; and outer conductors disposed at respective end portions of the component element assembly and electrically connected to the inner conductor.

2. The multilayer coil component according to claim 1, wherein each of the outer conductors includes an end surface portion disposed on a respective end surface of the component element assembly and a side-surface folded portion disposed on a side surface of the component element assembly, and each of the second regions is disposed from the respective end surface of the component element assembly to at least an edge of the side-surface folded portion.

3. The multilayer coil component according to claim 2, wherein the inner conductor includes a coil portion and an extended conductor portion, and the coil portion is embedded in the first region.

4. The multilayer coil component according to claim 2, wherein a difference between the content of the nonmagnetic material in each of the second regions and the content of the nonmagnetic material in the first region is 25% by volume or more in terms of a volume ratio.

5. The multilayer coil component according to claim 2, wherein the content of the nonmagnetic material in the second region is 25% by volume or more in terms of a volume ratio.

6. The multilayer coil component according to claim 2, wherein the content of the nonmagnetic material in the first region is 75% by volume or less in terms of a volume ratio.

7. The multilayer coil component according to claim 2, wherein a cross section of the component element assembly is an observation region, an area ratio in the observation region of a constituent element that is not contained in the magnetic material and that is contained in only the nonmagnetic material is calculated, and the content of the nonmagnetic material in terms of a volume ratio is determined on the basis of the area ratio.

8. The multilayer coil component according to claim 1, wherein the inner conductor includes a coil portion and an extended conductor portion, and the coil portion is embedded in the first region.

9. The multilayer coil component according to claim 1, wherein the inner conductor includes a coil portion and an extended conductor portion, and the inner conductor is disposed in the first region.

10. The multilayer coil component according to claim 9, wherein one principal surface of each of the second regions is disposed in contact with a respective one of the outer conductors, and an other principal surface is in contact with the inner conductor.

11. The multilayer coil component according to claim 1, wherein a difference between the content of the nonmagnetic material in each of the second regions and the content of the nonmagnetic material in the first region is 25% by volume or more in terms of a volume ratio.

12. The multilayer coil component according to claim 1, wherein the content of the nonmagnetic material in the second region is 25% by volume or more in terms of a volume ratio.

13. The multilayer coil component according to claim 1, wherein the content of the nonmagnetic material in the first region is 75% by volume or less in terms of a volume ratio.

14. The multilayer coil component according to claim 1, wherein the nonmagnetic material contains at least Si and Zn.

15. The multilayer coil component according to claim 14, wherein the content of Zn relative to the content of Si is 1.8 to 2.2 in terms of a molar ratio.

16. The multilayer coil component according to claim 1, wherein the primary component of the magnetic material is a ferrite material that contains at least Fe, Ni, Cu, and Zn.

17. The multilayer coil component according to claim 16, wherein the magnetic material contains 0.3 to 5 parts by weight of Co in terms of $Co_3O_4$ relative to 100 parts by weight of the primary component.

18. The multilayer coil component according to claim 16, wherein the magnetic material contains 0.024 to 0.23 parts by weight of Bi in terms of $Bi_2O_3$ relative to 100 parts by weight of the primary component.

19. The multilayer coil component according to claim 1, wherein the inner conductor contains Ag as a primary component.

20. The multilayer coil component according to claim 1, wherein the second regions contain the magnetic material and the nonmagnetic material, and in the second region, the magnetic material and the nonmagnetic material do not overlap each other and are present as isolated subregions.

* * * * *